United States Patent [19]

Terashima et al.

[11] Patent Number: 4,718,504

[45] Date of Patent: Jan. 12, 1988

[54] TRENCH EXCAVATOR

[75] Inventors: Tutomu Terashima, Meguro; Hiroyuki Kawasaki, Hachiouji; Tadao Takahashi, Setagaya, all of Japan

[73] Assignee: Tone Boring Co., Ltd., Japan

[21] Appl. No.: 837,202

[22] Filed: Mar. 10, 1986

[30] Foreign Application Priority Data

Mar. 15, 1985 [JP] Japan ..... 60-52052
Mar. 28, 1985 [JP] Japan ..... 60-64314

[51] Int. Cl.[4] ..... E21B 4/02; E21B 4/04
[52] U.S. Cl. ..... 175/96; 175/102
[58] Field of Search ..... 175/92, 96, 102, 104; 299/39

[56] References Cited

U.S. PATENT DOCUMENTS 2,950,902 8/1960 Olds ..... 175/91
3,770,067 11/1973 Ikeda ..... 175/96
3,894,587 7/1975 Sourice ..... 175/96

*Primary Examiner*—Stephen J. Novosad
*Assistant Examiner*—William P. Neuder
*Attorney, Agent, or Firm*—Parkhurst & Oliff

[57] ABSTRACT

A trench excavator capable of excavating a trench of a rectangular section suitable for formation of an underground diaphragm wall. The underground diaphragm walls are now applied as underground structures replacing caissons, rigid foundations for multistory or tower like buildings, underground tanks and the like. In the trench excavator according to the invention, a pair of drum cutters and a ring cutter interposed therebetween form one unit and a plurality of such units are arranged parallel to one another, whereby an unexcavated portion produced between the drum cutters can be cut out by the ring cutter, leaving no unexcavated portion.

6 Claims, 6 Drawing Figures

TRENCH EXCAVATOR

BACKGROUND OF THE INVENTION

1. Field of the Invention

This invention relates to a trench excavator, and more particularly is concerned with a trench excavator which is capable of excavating a trench of a rectangular section suitable for an underground diaphragm wall.

2. Description of the Prior Art

Underground diaphragm walls are now applied as underground structures replacing caissons, rigid foundations for multistory buildings and for tower-like buildings, underground tanks and the like. To form such an underground diaphragm wall, at first a trench excavator is operated to excavate a wall-like trench in the underground with the trench being filled with a stabilizer such as bentonite muddy water and the like during such excavation. Next, reinforcements are placed down into the excavated trench and concrete is poured down into the excavated trench from the ground to form "1 element" wall. Then, a plurality of such element walls are connected to one another to produce one continuous wall as a whole in the underground. This continuous wall is called a diaphragm wall.

Conventionally, there have been proposed various kinds of trench excavators which can be used to excavate the above-mentioned underground diaphragm walls. For example, in one type of conventional trench excavator, a plurality of vertical shafts are arranged parallel to one another and, in the lower ends of the vertical shafts, cutters are alternately set such that they overlap one another, whereby trenches can be excavated. However, the conventional trench excavators of the type that have the above-mentioned vertical rotary shafts are found disadvantageous in that the two ends of each of the excavated trenches are formed in an arc shape since the bits thereof are rotated in their horizontal planes. By the way, there has been known an underground diaphragm walling system using no locking pipes, wherein, after setting of concrete, while the end face of a previously formed concrete foundation is being excavated, an adjacent trench is excavated. When applied in this diaphragm walling system, the trench excavator of the above-described conventional type presents another disadvantage in that it is unable to excavate the trench accurately in its predetermined shape and position, because the rotational movements of the cutters thereof in their horizontal planes cause the excavator body to move.

As can be seen from the above description, the conventional trench excavator provided with the vertical rotary shafts is incapable of excavating a trench having a rectangular section. Accordingly, in order to eliminate the disadvantages of the above-mentioned conventional excavator, there have been proposed other types of trench excavators having horizontal rotary shafts and cutters secured to the two ends of each of the horizontal rotary shafts. The last-mentioned type of trench excavators are, for instance, disclosed in Japanese Utility Model Publication No. 2242 of 1975 and Japanese Patent Publication No. 4692 of 1981. However, the trench excavators disclosed in these publications also present some problems. That is, in these excavators, a portion corresponding to a clearance between a pair of drum cutters respectively provided at the two ends of each of the horizontal rotary shafts is left uncut, providing resistance during excavation. Also, in structure, reverse suction ports exist in the upper portions of the drum cutters, worsening removal of the excavated earth leaving slime in the trench bottom. This is due to the fact that, since the two drum cutters are respectively disposed on the two sides of a support member for each horizontal rotary shaft that, in order to rotate the horizontal rotary shaft, power transmission means for rotating the horizontal rotary shaft must be provided centrally thereof. The two drum cutters must thus be spaced from each other at least by the space for the support member so as to prevent interference between the support member and the drum cutters. If the distance between the cutters is shortened to reduce the unexcavated portion, then the space for the power transmission means is narrowed, resulting in insufficient power transmission and also decreasing the strength of the support member. On the contrary, in order to carry out sufficient power transmission, the two cutters must be spaced from each other by a distance that permits sufficient power transmission, so that the unexcavated portion is increased accordingly. Such unexcavated portion not only provides an obstacle to smooth trench excavating operations but also brings forthe a poor efficiency in removing excavated earth since the reverse suction ports are located in the upper portions of drum cutters. Consequently, the slime may be left on the trench bottom, which has an ill effect on the strength of the underground diaphragm wall itself. In addition, according to such trench excavators, the space available for the support member is structurally confined to thereby weaken the support member in strength. Therefore, these trench excavators are not suitable for excavation of trenches forming a thick wall (e.g., a wall having a thickness of 1.5–3.2 m) which requires a great excavation power.

SUMMARY OF THE INVENTION

The present invention aims at eliminating the drawbacks found in the above-mentioned prior art trench excavators. Accordingly, it is a primary object of the invention to provide a trench excavator capable of forming an underground diaphragm wall which includes no unexcavated portion remaining therein and has a required strength.

In attaining the above object, according to the invention, there is provided a trench excavator, which comprises a suspendable excavator body, a pair of drum cutters disposed coaxially in the lower portion of said excavator body at a predetermined interval from each other and each having a horizontally-directed rotary shaft, a ring cutter interposed between said pair of drum cutters, and a rotation driving source for driving said pair of drum cutters and said ring cutter into rotation, characterized in that said pair of drum cutters and said ring cutter interposed therebetween form one unit and that a plurality of said units are arranged parallel to one another in the lower portion of said excavator body.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiments of a trench excavator according to the present invention with reference to the accompanying drawings.

Figure 1:
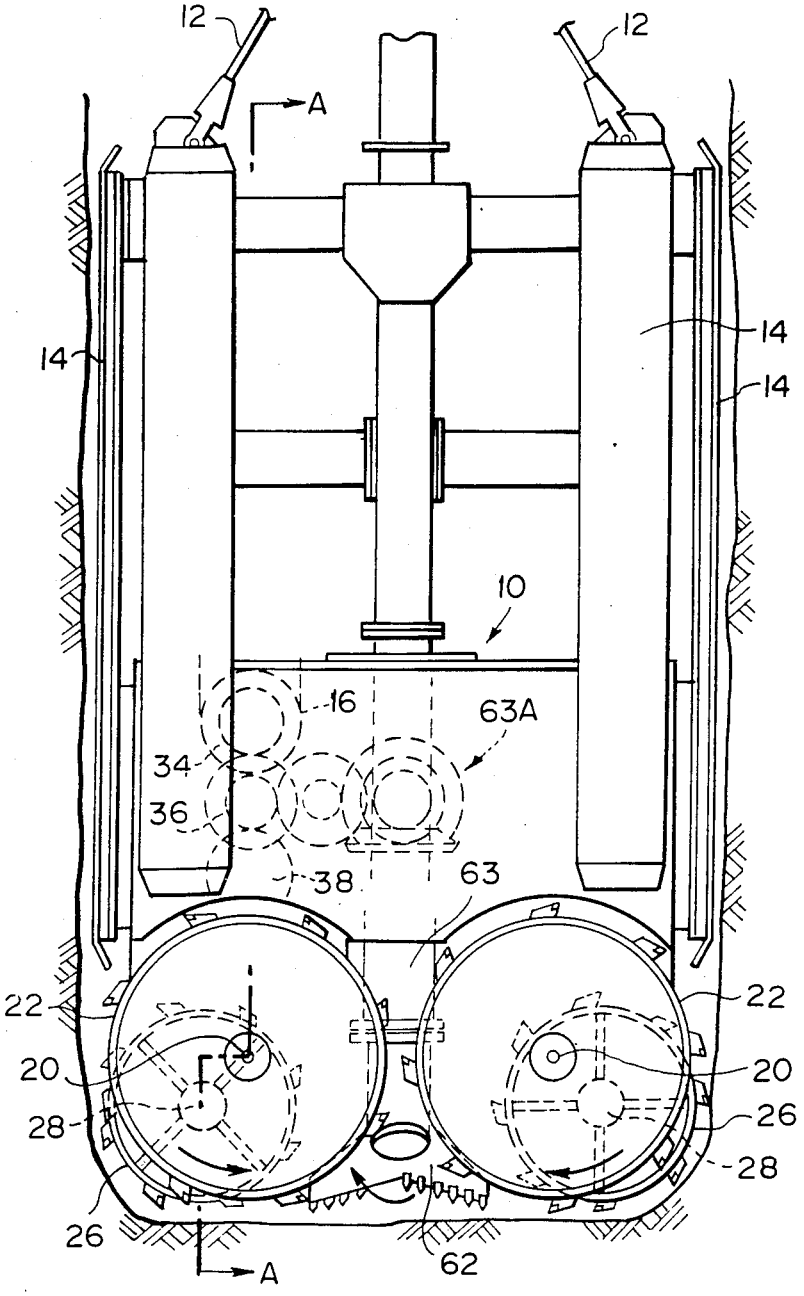
FIG. 1 is a front view of a first embodiment of the invention.

Referring first to FIG. 1, an excavator body 10 is constructed such that it can be suspended down from the ground via ropes 12, 12. The excavator body 10 is provided on the front and side faces thereof with a plurality of guides 14, 14, extending vertically and it also carries a rotation driving source 16 such as an electric motor, hydraulic motor or the like. The rotation driving source 16 may be a sealed-type electric motor or the like which can be used under water.

Figure 2:
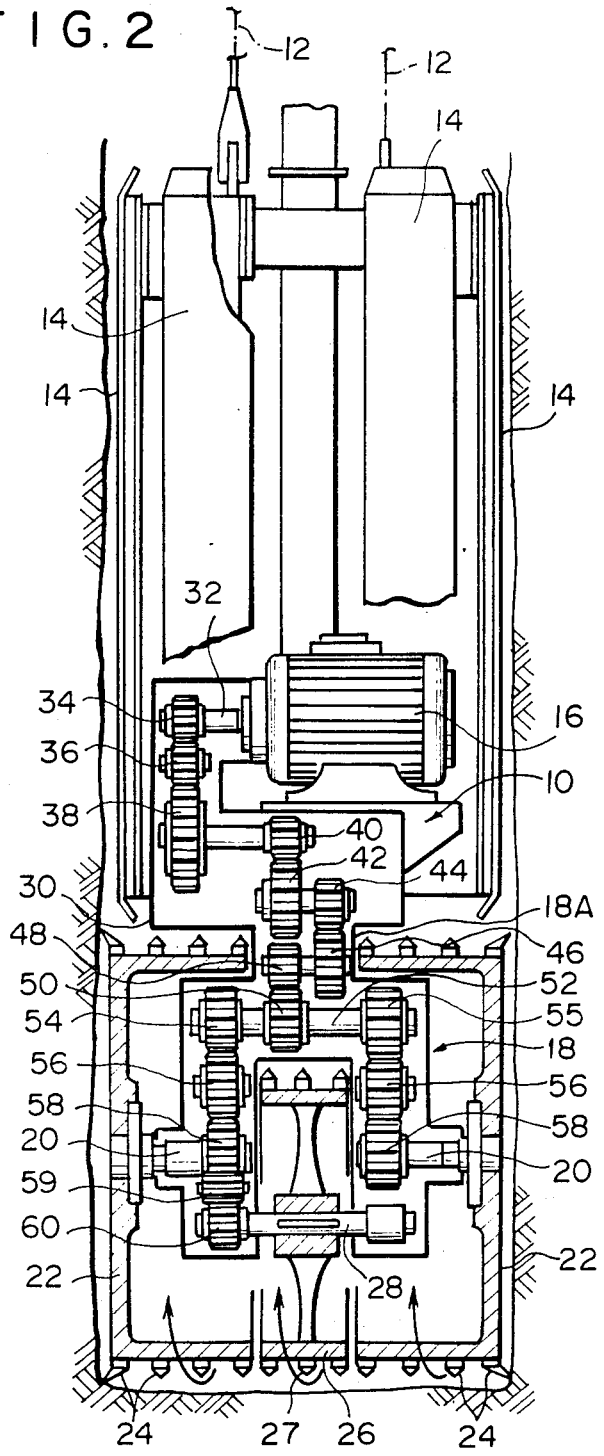
FIG. 2 is a section view of the embodiment in FIG. 1 taken along line A—A in FIG. 1.

As shown in FIG. 2, the excavator body 10 is formed in the lower portion thereof with a gear case 18 to which horizontal rotary shafts 20, 20 are rotatably mounted. Drum-like cutters (they are referred to as drum cutters hereinafter) 22, 22 are fixedly secured to the horizontal rotary shafts 20, 20, respectively. The drum cutter 22 is formed in such size that the gear case 18 can be stored therein. The drum cutter 22 is provided with a plurality of cutting edges 24 on the external peripheral surface thereof. The two drum cutters 22, 22 are located at a predetermined distance from each other, as shown in FIG. 2. In space formed above and between the drum cutters, there is provided a gear case 18A which serves to connect the gear case 18 with another gear case disposed on the side of the excavator body which will be described later. To the gear case 18 is pivotally mounted a horizontal rotary shaft 28 of a ring-like cutter (it is referred to as a ring cutter hereinafter) 26. Similarly to the drum cutter 22, the ring cutter 26 is formed with cutting edges 27 on the outer periphery thereof. The ring cutter 26 is formed smaller in diameter than the drum cutter 22 and its central axis 28 is situated eccentrically from the central axis of the drum cutter. In other words, as shown if FIG. 1, the ring cutter 26 is arranged with its horizontal rotary shaft 28 being eccentric in such a manner that the side and bottom surfaces of the drum cutter 22 are substantially level with the side and bottom surfaces of the ring cutter 26, respectively.

As shown in FIG. 2, above the gear case 18A there is provided a gear case 30 on the excavator body 10 side. In the gear cases 30, 18A and 18 there are arranged groups of reduction gears for transmitting power from the rotation driving source 16. That is, the motor 16 has an output shaft 32 to which a gear 34 is coupled. The power is then transmitted from the gear 34 to gears 36, 38, 40, 42,, 44 disposed in the gear case 30. The rotational forces of the gear 44 are transmitted via gears 46, 48 in the gear case 18A to a gear 50 in the gear case 18. Then, the rotational forces of the gear 50 are diverged into gears 54, 55 respectively disposed on both sides of a horizontal rotary shaft 52 and are then transmitted therefrom to the two drum cutters 22, 22, respectively. In other words, the rotational forces of the gears 54, 55 are respectively transmitted via idle gears 56, 56 to gears 58, 58 on the horizontal rotary shafts 20, 20 to rotate the horizontal rotary shafts 20, 20, thereby rotating the drum cutters 22, 22. Further, the left-side gear 58 is adapted to mesh via an idle gear 59 with a gear 60 fixed to the horizontal rotary shaft 28 to thereby rotate the ring cutter 26 as well.

As shown in FIG. 1, two units, each of which comprises a pair of drum cutters 22, 22 and the ring cutter 26 interposed between the two drum cutters 22, 22 and to which the rotational forces are transmitted in the above-described manner, are arranged parallel to each other. In such two units parallel arrangement, since the ring cutter 26 is formed smaller in diameter than the drum cutter 22, a clearance corresponding to such difference is produced between the opposing faces of the two units, in which clearance a bit 62 may be provided. This bit 62 is disposed in the lower end of a reverse shaft 63 as well as interposed between the ring cutters. The reverse shaft 63 is adapted to rotate the bit 62 by means of gear transmission means 63A diverged from the above-mentioned gear transmission means connecting the rotation driving source 16 to the drum cutters 22. Cut slimes produced by the drum cutters 22, ring cutter 26 and bit 62 are removed through the interior of the reverse shaft 63 up onto the ground. The reverse shaft 63 may be rotated using the rotation driving source 16, or there may be provided a special rotation driving source for the reveres shaft 63.

Now, the action of the embodiment of the invention arranged in the above-mentioned manner is described. First, the rotational forces generated from the rotation driving source 16 are transmitted via the gear transmission means in the gear cases 30, 18A and 18 to the drum cutters 22 and ring cutter 26. In such transmission, as shown in FIG. 1, the drum cutters 22 and ring cutters 26 of the right and left units are rotated in the opposite directions to each other so that cutting reaction torques produced by them can cancel each other. In such condition, when the excavator body 10 is lowered downwardly, then a trench of a rectangular shape can be excavated in the underground.

Figure 3:
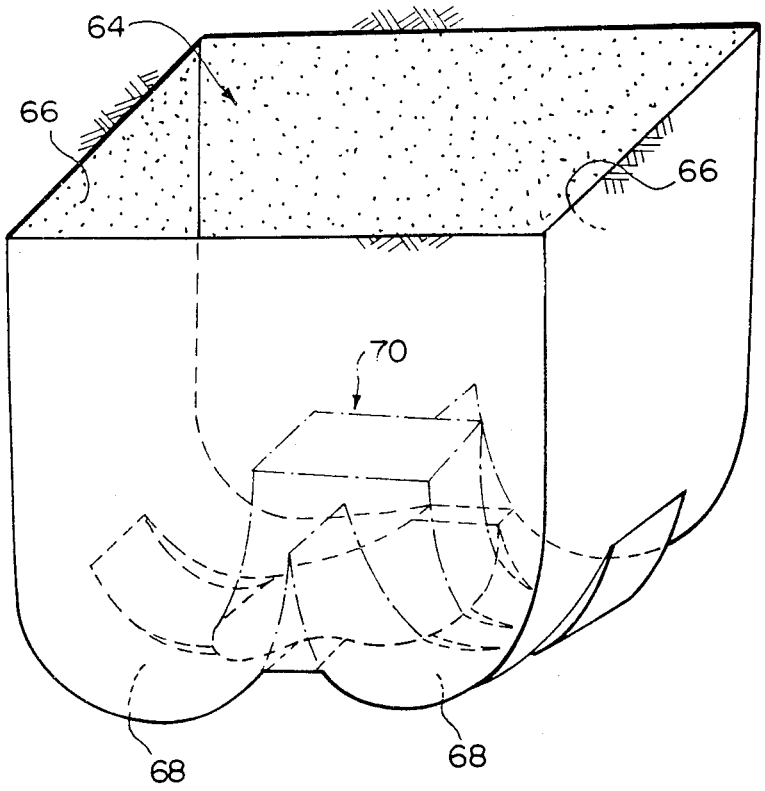
FIG. 3 is an explanatory view showing the shape of a trench excavated using the trench excavator of the invention.

In FIG. 3, there is shown a general form of a trench excavated using the trench excavator of the invention. As shown in FIG. 3, each of side faces 66 of a trench 64 is formed in smooth form since the side faces of the drum cutter 22 and ring cutter 26 are arranged to be substantially level with each other, and also the bottom faces 68, 68 are formed substantially in the same plane because the bottom faces of the drum cutter 22 and ring cutter 26 are located substantially level with each other. Although there is formed an unexcavated portion 70 in the central portion of the trench 64, it can be cut out by the bit 62 which, as described above, is provided between the opposing faces of the two units. And, slimes produced by such excavation are discharged through the reverse shaft 63 up onto the ground by means of a suction pump or the like.

Figure 4:
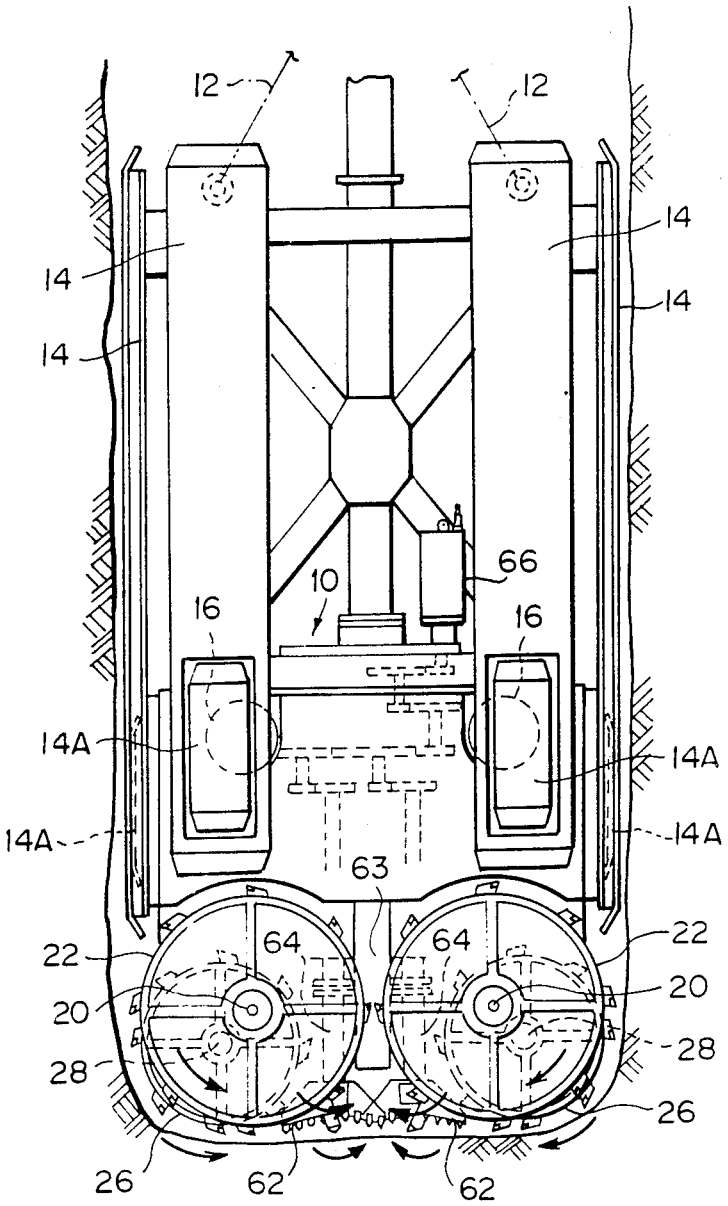
FIG. 4 is a front view showing the general construction of a second embodiment of the invention.

Although in the above-described embodiment one bit 62 is used, two bits 62 may be employed. In this case, the two bits 62 are to be rotated in the opposite directions to each other so that their cutting reaction torques can cancel each other. Namely, as shown in FIG. 4, two bit shafts 64, 64 may be provided respectively in both sides of the reverse shaft 63, and the two bits 62, 62 may be provided in the lower ends of the bit shafts 64, respectively. In the embodiment illustrated in FIG. 4, a driving source 66 specially designed for the bits 62 is provided. Also, each guide 14 is equipped with an adjustable guide 14A which can be freely advanced and retreated for attitude control. alternatively, two adjustable guides 14A may be provided in the upper and lower portions of each of the four peripheral surfaces of the excavator.

Figure 5:
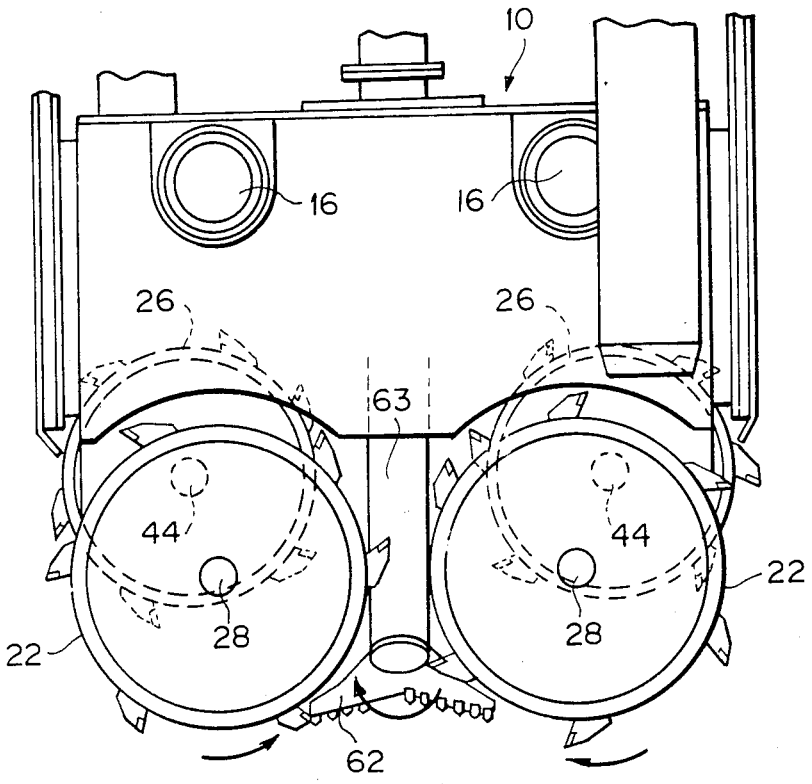
FIG. 5 is a front view showing another example of an arrangement of ring cutters employed in the trench excavator of the invention.
Figure 6:
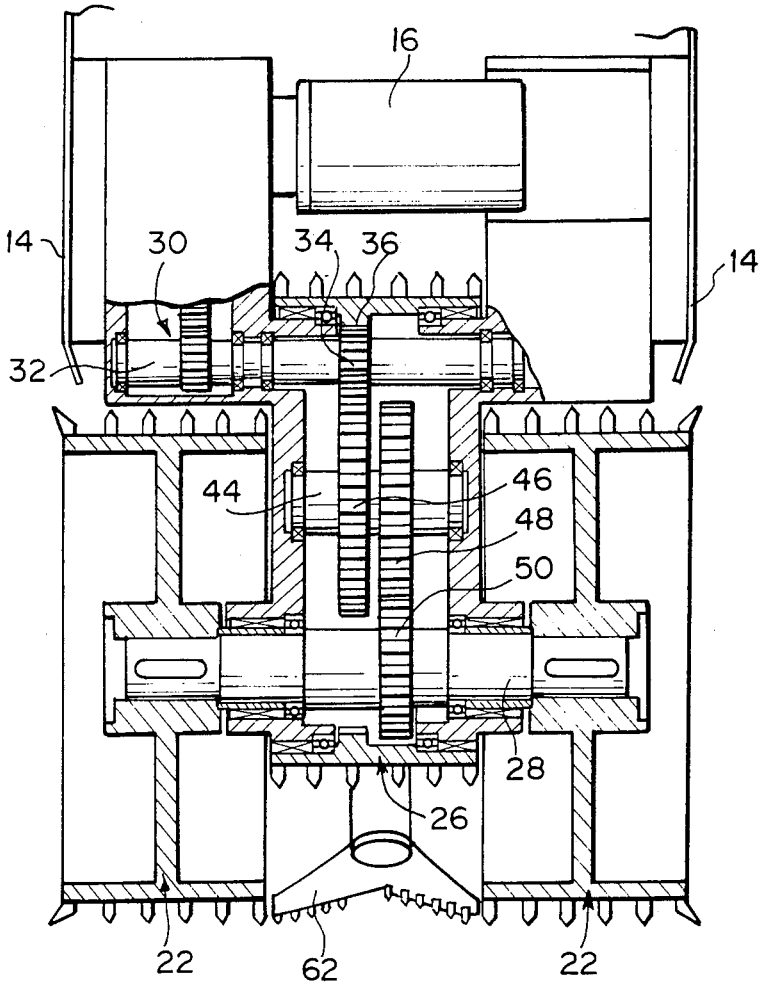
FIG. 6 is a section view showing another power transmission mechanism according to the invention.

Referring now to FIG. 5, there is shown another embodiment of the invention which incorporates another type of power transmission mechanism. As shown in FIGS. 5 and 6, the drum cutters 22, 22 are mounted to the horizontal rotary shafts 28, respectively, and each of the ring cutter 26 is located such that its axis is situated above the horizontal rotary shaft 28. Therefore, in the portion of the ring cutter 26 that projects upwardly of the drum cutter 22, as shown in FIG. 6, there is formed a space which can be used to transmit the rotational forces from the rotation driving source 16 to the ring cutter 26 and drum cutter 22.

Next, we will describe the power transmission mechanism which transmits the power from the rotation driving source 16 to the drum cutters 22 and ring cutter 26. As shown in FIG. 6, the rotational forces from the rotation driving source 16 are first transmitted via a group of reduction gears 30 to a horizontal rotary shaft 32 to rotate it. This horizontal rotary shaft 32 extends from a space formed above the ring cutter 26 into the ring cutter 26 and is provided with a gear 34 which is engaged with an internal gear 36 formed on the internal peripheral surface of the ring cutter 26. Therefore, the rotational forces of the rotation driving source 16 can be transmitted via the reduction gear group 30, horizontal rotary shaft 32 and gear 34 to the ring cutter 26 to rotate the ring cutter 20.

Also, since the gear 34 of the horizontal rotary shaft 32 is engaged with a gear 46 formed on a horizontal rotary shaft 44, the horizontal rotary shafat 44 can also be rotated. The horizontal rotary shaft 44 is provided with a gear 48 which is engaged with a gear 50 fixed to the horizontal rotary shaft 28 of the drum cutters 22. Therefore, the power from the rotation driving source 16 can be transmitted via the reduction gear group 30, horizontal rotary shaft 40, gears 42, 46, horizontal rotary shaft 44, gears 48, 50 to the drum cutters 22.

As shown in FIG. 5, two units are arranged parallel to each other, each of which is composed of a pair of drum cutters 22, 22 and one ring cutter 26 interposed between the two drum cutters 22, 22 and to which the power is transmitted in the above-mentioned manner.

The thus arranged embodiment of the invention has the same action and effects as in the first embodiment of the invention illustrated in FIG. 1.

In the above embodiment shown in FIGS. 5 and 6, the ring cutter 26 is formed slightly smaller in diameter than the drum cutter. However, the diameters of them may be equal to each other.

As has been described hereinabove, according to the trench excavator of the invention, since the cutters are provided on the horizontal rotary shafts, a rectangular trench can be excavated as well as the end faces of concrete previously set can be excavated easily. Also, according to the invention, a pair of drum cutters are arranged on the horizontal rotary shafts at a given interval from each other, and one ring cutter is interposed between these drum cutters, whereby the rotational forces of the rotation driving source can be transmitted to both of the drum cutters and ring cutter and the portion existing between the two drum cutters can be excavated by the ring cutter, eliminating a possibility of producing any unexcavated portion as in the prior art excavators.

Further, the provision of the ring cutter between the drum cutters permits a large space for the support member so that a trench of a great wall thickness can be excavated, as well as such provision enables the reverse suction port to approach the trench bottom, which permits excavation of a flat trench in a high efficiency of earth removal.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A trench excavator comprising:

a suspendable excavator body;

a driving source mounted in said excavator body;

a pair of drum cutters disposed coaxially in the lower portion of said excavator body at a predetermined distance from each other, each of said drum cutters having a horizontally-directed rotational axis;

a cylindrical ring cutter interposed between said pair of drum cutters and having an axis parallel to the rotational axes of said drum cutters, said ring cutter axis being located downwardly eccentrically with respect to said drum cutters axes; and a power transmission mechanism for transmitting power from said driving source by means of a space formed between the upper opposing faces of said pair of drum cutters, wherein said pair of drum cutters and said ring cutter interposed therebetween form one unit and a plurality of such units are arranged parallel to one another in the lower portion of said excavator body, and that within a space formed between said units there is provided a reverse shaft and on both sides of said reverse shaft there are provided a pair of bit shafts each having a bit in the lower portion thereof.

2. A trench excavator as set forth in claim 1, wherein said ring cutter is formed smaller in diameter than said pair of drum cutters.

3. A trench excavator as set forth in claim 2, wherein said driving source is an electric motor operable under water.

4. A trench excavator as set forth in claim 2, wherein said driving source is a hydraulic motor operable under water.

5. A trench excavator comprising:

a suspendable excavator body;

a driving source mounted in said excavator body;

a pair of drum cutters disposed coaxially in the lower portion of said excavator body at a predetermined distance from each other, each of said drum cutters having a horizontally-directed rotational axis;

a cylinderical ring cutter interposed between said pair of drum cutters and having an axis parallel to the rotational axes of said drum cutters, said ring cutter axis being located downwardly eccentrically with respect to said drum cutters axes; and a power transmission mechanism for transmitting power from said driving source by means of a space formed between the upper opposing faces of said pair of drum cutters, wherein said pair of drum cutters and said ring cutter interposed therebetween form one unit and a plurality of such units are arranged parallel to one another in the lower portion of said excavator body, and that within a space formed between said units there is provided a reverse shaft equipped with a bit.

6. A trench excavator comprising:

a suspendable excavator body;

a driving source mounted in said excavator body;

a pair of drum cutters disposed coaxially in the lower portion of said excavator body at a predetermined distance from each other, each of said drum cutters having a horizontally-directed rotational axis;

a cylindrical ring cutter interposed between said pair of drum cutters and having an axis parallel to the rotational axes of said drum cutters, said ring cutter axis being located upwardly and eccentrically with respect to said drum cutters axes; and a power transmission mechanism for transmitting power from said driving source through a space within said ring cutter to said ring cutter and said drum cutters, wherein said pair of drum cutters and said ring cutter interposed therebetween form one unit and a pluralitiy of such units are arranged parallel to one another in the lower portion of said excavator body, and that within a space formed between said units there is provided a reverse shaft equipped with a bit.

* * * * *